US007387115B1

(12) United States Patent
Katoh et al.

(10) Patent No.: US 7,387,115 B1
(45) Date of Patent: Jun. 17, 2008

(54) PLASMA IGNITION SYSTEM

(75) Inventors: Hideyuki Katoh, Nishio (JP); Tooru Yoshinaga, Okazaki (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/896,534

(22) Filed: Sep. 4, 2007

(30) Foreign Application Priority Data

Dec. 20, 2006 (JP) ..... 2006-342390
Jun. 13, 2007 (JP) ..... 2007-156178

(51) Int. Cl.
*F02P 3/02* (2006.01)
*F02P 3/06* (2006.01)

(52) U.S. Cl. ..... 123/620; 123/143 B

(58) Field of Classification Search ..... 123/620, 123/640, 143 B, 143 R, 655, 596; 315/201
See application file for complete search history.

(56) References Cited

U.S. PATENT DOCUMENTS 4,122,816 A * 10/1978 Fitzgerald et al. ..... 123/598
4,308,488 A 12/1981 Imai et al.
4,327,702 A 5/1982 Imai et al.
4,354,136 A 10/1982 Hamai et al.
4,396,855 A * 8/1983 Imai et al. ..... 313/139
4,510,915 A * 4/1985 Ishikawa et al. ..... 123/620

FOREIGN PATENT DOCUMENTS

JP 55-172658 12/1980
JP 57-172172 10/1982
JP 60-098167 6/1985

* cited by examiner

*Primary Examiner*—Mahmoud Gimie
(74) *Attorney, Agent, or Firm*—Nixon & Vanderhye PC

(57) ABSTRACT

A plasma ignition system has an electromagnetic noise reduction circuit in addition to a discharge power circuit, a plasma generating power circuit, a plasma ignition plug, a discharging wire and a plasma generating wire. The noise reduction circuit includes a first rectifier connected to the discharging wire, a second rectifier connected to the plasma generating wire, and a noise reducing capacitor connected in parallel to the second rectifier. The noise reduction circuit is disposed close to the ignition plug so that the noise reducing capacitor bypasses only high frequency noise currents generated when the ignition plug discharges.

10 Claims, 11 Drawing Sheets

PLASMA IGNITION SYSTEM

CROSS REFERENCE TO RELATED APPLICATION

This application is based on and incorporates herein by reference Japanese Patent Applications No. 2006-342390 filed on Dec. 20, 2006 and No. 2007-156178 filed on Jun. 13, 2007.

FIELD OF THE INVENTION

The present invention relates to a plasma ignition system having a noise reduction circuit.

BACKGROUND OF THE INVENTION

A normal ignition system for an internal combustion engine of a vehicle, etc. has, as shown in FIG. 10A, an ignition plug 10, a battery 31, an ignition switch 32, an ignition coil 33, an electronic control unit (ECU) 35, an igniter (transistor) 34, and the like In this system, as shown in FIG. 10B, when the ECU 35 generates an ignition signal after the ignition switch 32 is turned on, the igniter 34 turns on so that a voltage (e.g., 12 V) of the battery 31 is applied to a primary winding 331 of the ignition coil 33 causing a primary current in the primary winding 331. When the ignition signal disappears and the igniter 34 turns off, the primary current is cut off causing a magnetic field change in the ignition coil 33. A secondary winding 332 of the ignition coil 33 generates a secondary voltage of −10 to −30 kV in response to the magnetic field change. This secondary voltage generates electric discharge in a discharge space (gap) 140 between a center electrode 110 and a ground electrode 131 in the ignition plug 100, so that a high temperature zone is locally formed in a limited area. At this moment, a current of about 35 mA, which is rectified by a rectifier (diode) 21, flows in the secondary winding 332, and energy of about 35 mJ is discharged. In normal spark ignition by the ignition plug 10, this high temperature zone becomes a source of ignition to ignite compressed air-fuel mixture supplied to a combustion chamber of the engine for mixture explosion.

A plasma ignition system for an internal combustion engine of a vehicle, etc. also has, as shown in FIG. 11A, an ignition plug 10, a battery 31, an ignition switch 32, an ignition coil 33, an electronic control unit (ECU) 35, and an igniter (transistor) 34, as the normal system shown in FIG. 11A. In addition, the plasma ignition system has a plasma generating power circuit 4, which includes a battery 41, a resistor 42, a plasma generating capacitor or capacitors 43 and a rectifier 22. The ignition plug 10 is a plasma type, which includes an insulator 120 surrounding a center electrode 110 and defining a discharge gap 140. The capacitor 43 is provided to store electric energy by being charged by the battery 41 through the resistor 42.

In this plasma ignition system, as shown in FIG. 11B, a secondary voltage of about −10 to −30 kV is generated in the similar manner as in the normal ignition system. In addition, at a moment when the secondary voltage reaches a discharge voltage proportional to a discharge distance D between the electrodes 110 and 131, the energy stored in the capacitor 43 is instantly discharged in the discharge space 140 so that high temperature plasma gas in the discharge space 140 is generated. At this moment, high energy of about 100 mJ is emitted.

In this plasma ignition system, a relatively large high temperature zone is formed by very high energy and becomes a flame kernel of high directivity, which ignites compressed air-fuel mixture in an engine. Thus, the plasma ignition system is expected to be applied to a stratified combustion in a direct-injection engine, in which lean air-fuel mixture is combusted by supplying rich air-fuel mixture only around the ignition plug.

Since the energy stored in the capacitor 43 is supplied to the ignition plug 10 instantaneously, a large current of about 120 A flows in the negative direction during a discharge period of about 8 μs as shown in FIG. 10B. This occurs at every predetermined rotation of the engine, and hence high frequency electromagnetic noise N is generated. This noise is likely to cause various electronic control systems mounted in a vehicle. This may lead to misfire in the engine.

To counter this electromagnetic noise, U.S. Pat. No. 4,308,488 (JP-U-55-156263) proposes to form an electric wire of a plasma generating circuit and provide a steering diode in this electric wire at a position close to an ignition plug. This proposal will not cause reduction in a voltage supplied to a primary winding of an ignition coil from a discharging power circuit.

Since the shield wire has low flexibility, wiring the shield wire becomes difficult. If the shield wire has an imperfectly shielded part, electromagnetic noise leaks. As a result, the other electric wire of a discharging power circuit and a plug cap need be shielded. This shield may not be easily provided in a crowded engine compartment. In some instances, this shield itself operates as an antenna and generates electromagnetic noise. Further, since the stray capacitance formed between the shield and the electric wire of the plasma generating power circuit changes irregularly in accordance with bending, this may result in a new source of noise.

Further, the ignition coil and the plasma ignition plug is likely to form a transmission circuit, which generates electromagnetic noise when the ignition plug starts to discharge in response to the secondary voltage of the ignition coil. The electric wire is likely to operate as an antenna and radiates the noise outward. Since a large current must flow in the electric wire, it is not possible to stop generation of electromagnetic noise, which is generated at a start of discharging, by a resistor in the electric wire.

SUMMARY OF THE INVENTION

It is therefore an object of the present invention to provide a plasma ignition system, which radiates less electromagnetic noise outward.

According to one aspect of the present invention, a plasma ignition system for an engine comprises an ignition coil, a discharging power circuit, a plasma generating power circuit, an ignition plug, a discharging wire, a plasma generating wire, and an electromagnetic noise reduction capacitor. The ignition coil receives a primary voltage and generates a secondary voltage higher than the first voltage based on the first voltage. The discharging power circuit includes an igniter for controlling the ignition coil. The plasma generating power circuit includes a plasma generating capacitor, which is charged by a voltage supplied thereto. The ignition plug is mounted on the engine and having a cylindrical discharge space defined by a center electrode and a ground electrode. The ignition plug forms plasma gas in the discharge space by receiving the secondary voltage from the discharging power circuit and a plasma generating power form the plasma generating power circuit. The discharging wire connects the discharging power circuit and the center electrode. The plasma generating wire connects the plasma generating power circuit and the center electrode. The electromagnetic noise reduction circuit includes a first rectifier, a second rectifier and a noise reducing capacitor. The first rectifier is disposed in the discharging wire to block a current flowing in the plasma generating wire from flowing into the discharging wire. The second rectifier is disposed in the plasma generating wire to block a current flowing in the discharging power wire from flowing into plasma generating power circuit. The noise reducing capacitor is disposed in parallel to the second rectifier at a position between the plasma generating power circuit and the second rectifier.

The noise reducing capacitor may be provided separately from the plasma generating capacitor or may be a part or all of the plasma generating capacitor.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE EMBODIMENT

First Embodiment

Figure 1:
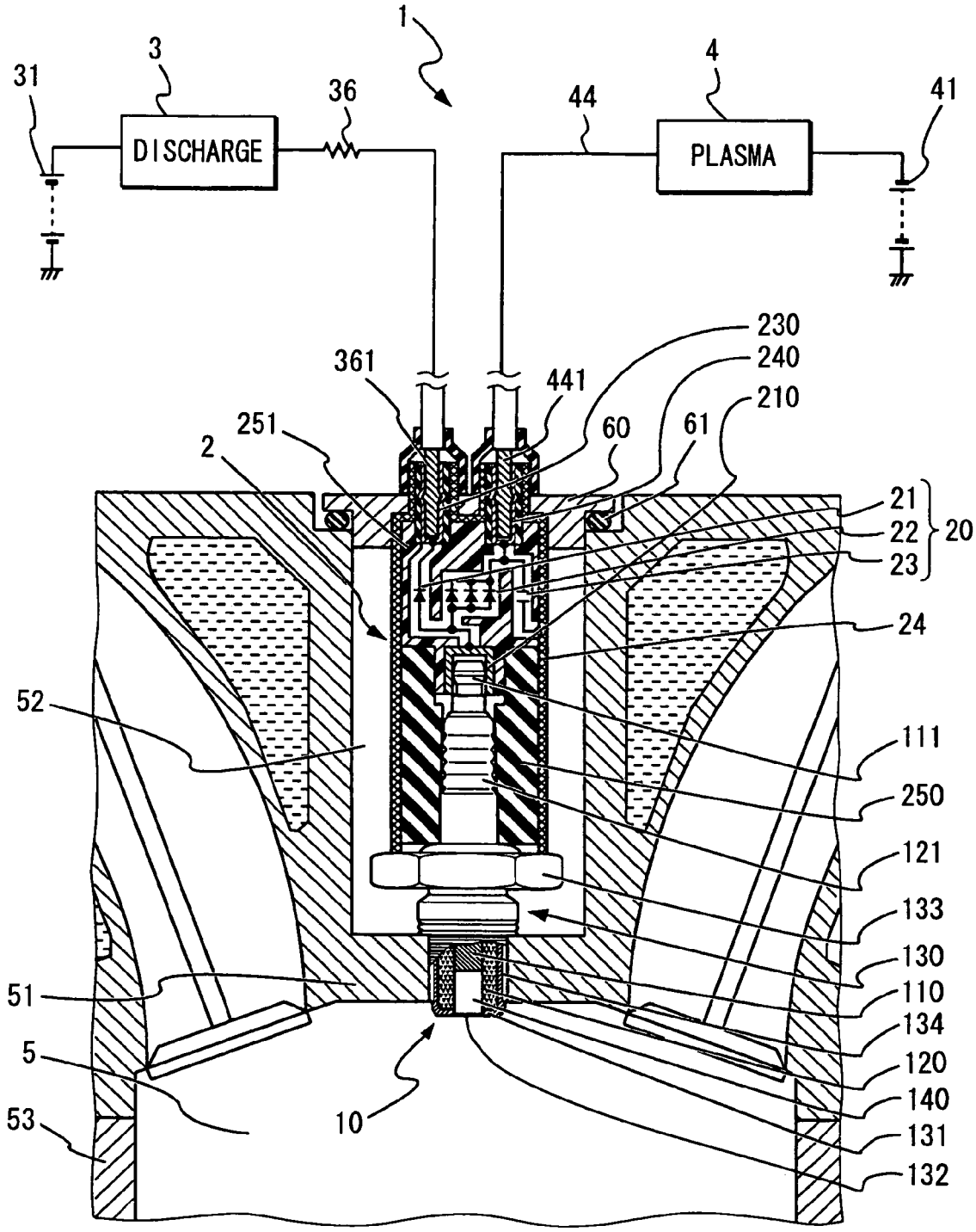
FIG. 1 is a block diagram of a plasma ignition system, showing partly in section, according to a first embodiment of the present invention.

Referring first to FIG. 1, a plasma ignition system 1 has a plasma type ignition plug 10, an electromagnetic noise reduction circuit 20, a discharging power circuit 3, and a plasma generating power circuit 4. The noise reduction circuit 20 is provided within a plug cap 2 and connected to the discharging power circuit 3 and the plasma generating power circuit 4 via a discharging power supply electric wire (discharging wire) 36 and a plasma generating power supply electric wire (plasma generating wire) 44, respectively. The discharging power circuit 3 is connected to a positive terminal of a first battery 31. The plasma generating power circuit 4 is connected to a negative terminal of a second battery 4.

The ignition plug 10 is fitted in a plug hole 52 of an engine block 51 so that its top end is exposed into a combustion chamber 5 defined by an engine block 51, a cylinder block 53 and a piston (not shown). The ignition plug 10 has a center electrode 110, an insulator 120, and a meal housing 130. The center electrode 110 is made of a conductive metallic material in a columnar shape, and has a bottom end conductive to a terminal 111. The insulator 120 is in a cylindrical shape and tightly holds the center electrode 110 therein while insulating it from the ground electrode 131 and the like. The housing 130 is made of metal and cylindrical in shape. The top end of the housing 130 is bent inward in the radial direction to form a ground electrode 131, which has an annular opening 132. A discharge space 140 is formed by the top end surface of the center electrode 110, an inner side surface of the insulator 120 and an inner side surface of the opening 132.

The housing 130 is formed with a hexagonal part 133 and a thread 134 on its outer peripheries. The hexagonal part 133 is provided to screw-thread the thread 134 in the plug hole 52. The thread 134 is provided on the top end side to be thread-engaged with the engine block 51 by turning the hexagonal part 133, thus electrically connecting the ground electrode 131 to the engine block 51.

In addition to the noise reduction circuit 20, the plug cap 2 includes a first terminal 210, a second terminal 230, a third terminal 240, an insulating seal 250 and insulating resin mold 251, all of which are covered with an electromagnetic shield case 24. The first terminal 210 is connected to the terminal 111 of the center electrode 110. The second terminal 230 is connected to a terminal 361 of the discharging wire 36. The third terminal 240 is connected to a terminal 441 of the plasma generating wire 44. The insulating seal 250 is in a cylindrical shape and made of elastic material, and fitted on a head 121 of the insulator 120. The resin mold 251 is made of epoxy resin or the like and encapsulates the noise reduction circuit 20.

The case 24 may be made of metal in its entirety or made of resin plated with metallic material, so that its metallic part operates as an electromagnetic shield. Since the shape or volume of case 24 is fixed and not variable, a difference in shield capacitances from one case to another case is limited to a small value. As a result, even in a case that the ignition plug 10 is mounted on each cylinder of a multi-cylinder engine, no potential difference arises due to differences in the stray capacitances of multiple shields. That is, the case 24 does not become a new source of electromagnetic noise.

The case 24 is grounded to the engine block 51 through the hexagonal part 133. The plug cap 2 is tightly held in the plug hole 52 by a fixing member 60 via an elastic member 61 such as a rubber O-ring. The fixing member 60 is made of metallic material and in contact with the engine block 51 to be electrically grounded.

The noise reduction circuit 20 includes a first rectifier 21, a second rectifier 22, and a capacitor 23. The first rectifier 21 allows a current flow in only a direction of its anode to its cathode, and blocks a current flow in the reverse direction. Therefore the first rectifier 21 blocks a negative current flowing in the plasma generating power wire 44 from flowing into the discharging power circuit 4. The second rectifier 22 allows a current flow in only a direction of its anode to its cathode, and blocks a current flow in the reverse direction. Therefore, the second rectifier 22 blocks a negative current flowing in the discharging power wire 36 from flowing into the plasma generating power circuit 4. The capacitor 23 is for restricting electromagnetic noise generation.

The electromagnetic noise increases as a length of wiring between the second terminal 230 and the center electrode 110 becomes long. Therefore, this length should be shortened as much as possible. This length of wiring is shortened by providing the noise reduction circuit 20 within the plug cap 2. Further, since the plug cap 2 is provided in the plug hole 51, a noise source is shielded by both case 24 and engine block 51. Thus, leak of electromagnetic noise is surely reduced.

Figure 2:
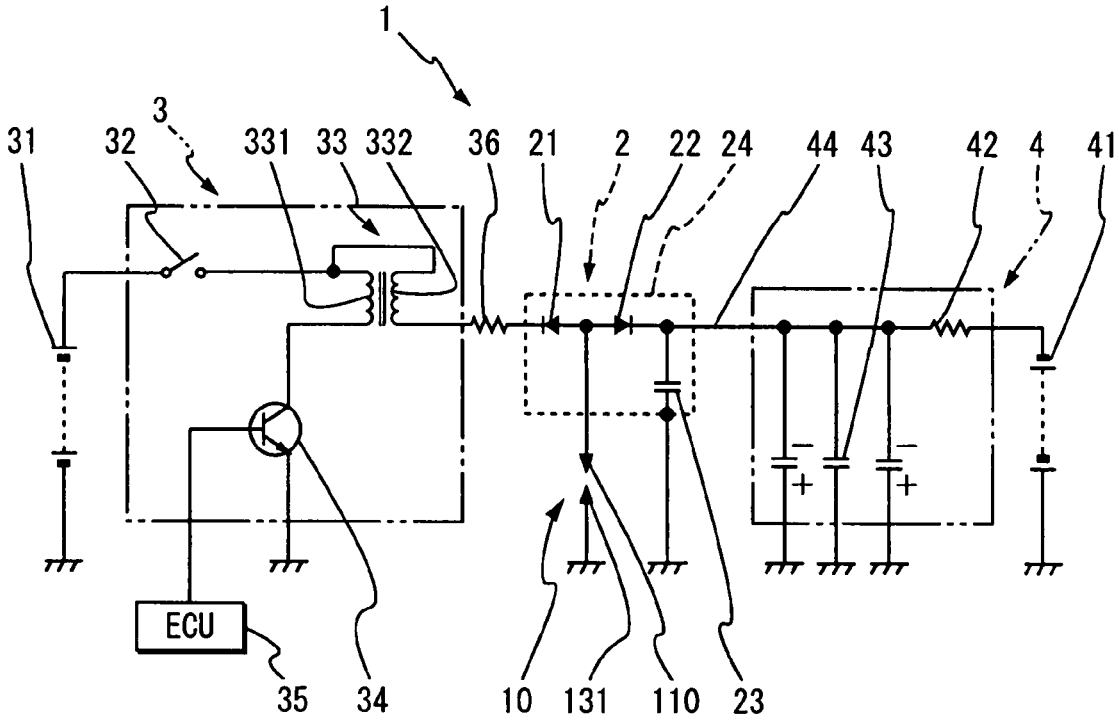
FIG. 2 is a circuit diagram of the plasma ignition system shown in FIG. 1.

As shown in FIG. 2, the discharging power circuit 3 is connected to the first battery 31 and an electronic control unit 35, and includes an ignition switch 32, an ignition coil 33, and an igniter (transistor and the like) 34. The plasma generating power circuit 4 is connected to the second battery 41, and includes a resistor 42, a plasma generating capacitor or capacitors 43. The capacitor 43 is charged by the second battery 41.

In the noise reduction circuit 20, the first rectifier 21 is connected in series between the discharging wire 36 and the center electrode 110, and the second rectifier 22 connected in series between the plasma generating wire 44 and the center electrode 110. The capacitor 23 is for restricting electromagnetic noise generation, and connected in parallel to the second rectifier 22 between the plasma generating power circuit 4 and the second rectifier 22. The diodes 21, 22, and the capacitor 23 are covered with the case 24. A ground-side terminal of the capacitor 23 and the case 24 are grounded through the ground electrode 131.

Preferably, the discharging wire 36 is a high voltage resistance wire, and the first and second rectifiers 21, 22 are diodes. Particularly, the second rectifier 22 includes a plurality of high voltage diodes connected in parallel.

In this embodiment, with the discharging power circuit 3, the ignition coil 33 generates a secondary voltage of about −10 to −30 kV in the similar manner as in the conventional ignition systems (FIGS. 10A, 10B, 10C, 10D). When the secondary voltage reaches a discharge voltage required for discharging between the center electrode 110 and the ground electrode 131, a discharge starts between the electrodes 110 and 131 so that gas in the discharge space 140 becomes plasma gas in a small area. This plasma gas is conductive and causes discharge of the electric charge stored in the plasma generating capacitor 43. As a result, the plasma gas in the discharge space is further expanded over a large area and provided into the combustion chamber 5.

Figure 3A:
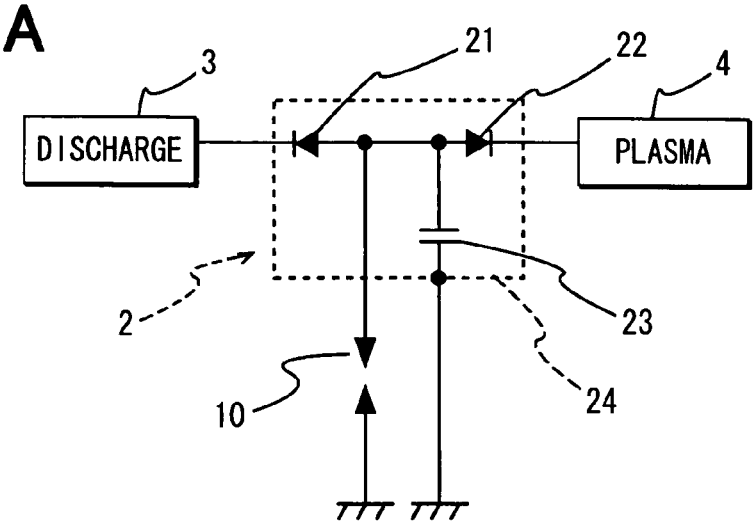
FIGS. 3A to 3C are circuit diagrams of a first to a third comparative examples of a plasma ignition system.
Figure 3B:
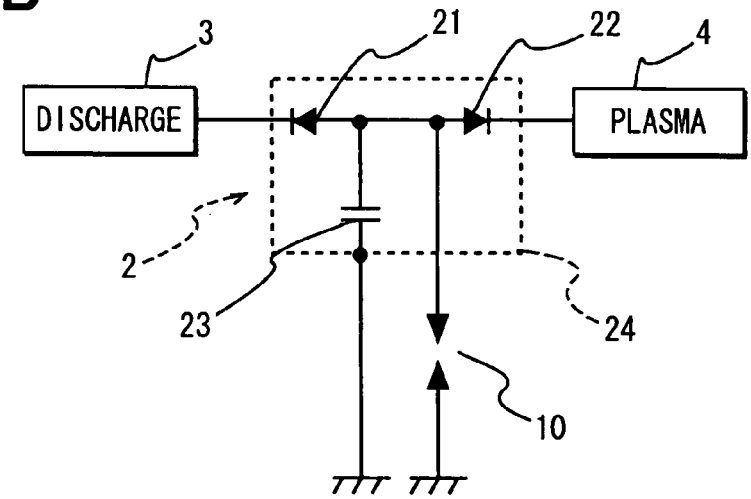
Figure 3C:
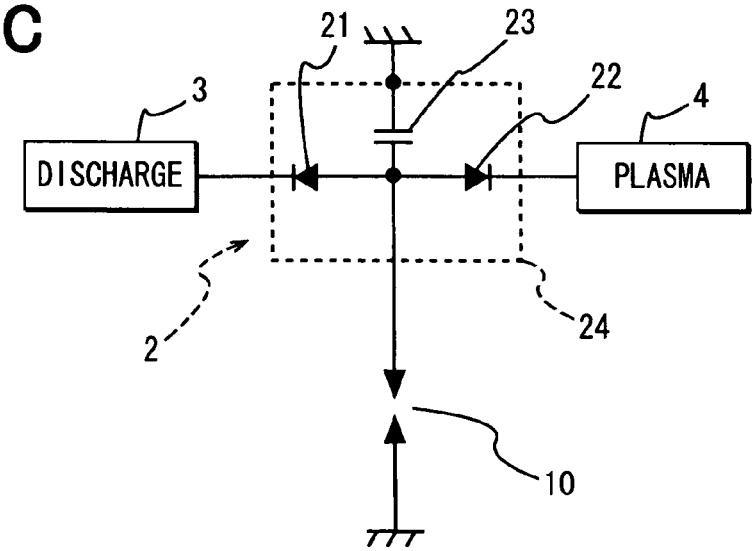

Operation of this embodiment was compared with those of first to third comparative examples shown in FIGS. 3A, 3B and 3C, respectively. It is noted that, in the embodiment (FIGS. 1, 2), the capacitor 23 is connected to a junction between the second rectifier 22 and the plasma discharging power circuit 44 and disposed very closely to the second rectifier 22. In the first comparative example (FIG. 3A), the capacitor 23 is connected to a junction between the first rectifier 21 and the second rectifier 22 and disposed more closely to the second rectifier 22 and the plasma generating power circuit 4 than the ignition plug 10 is. In the second comparative example (FIG. 3B), the capacitor 23 is connected to a junction between the first rectifier 21 and the second rectifier 22 and disposed more closely to the first rectifier 21 than the ignition plug 10 is. In the third comparative example (FIG. 3C), the capacitor 23 is connected to a junction between the first rectifier 21 and the second rectifier 22 and disposed at the same position as the ignition plug 10.

Figure 4A:
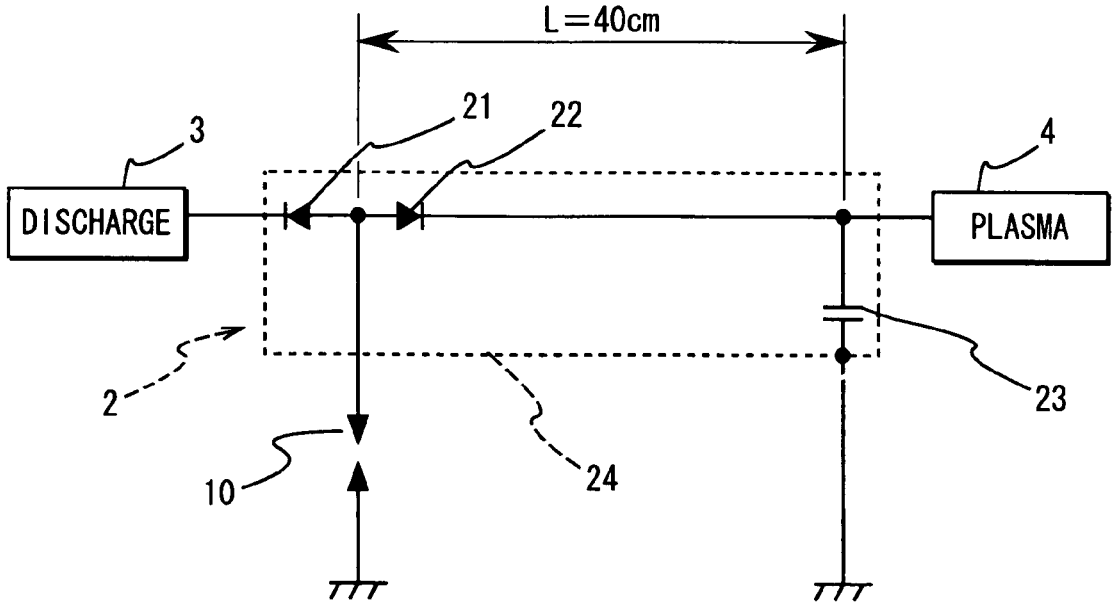
FIGS. 4A and 4B are circuit diagrams of a fourth and a fifth comparative examples of a plasma ignition system.
Figure 4B:
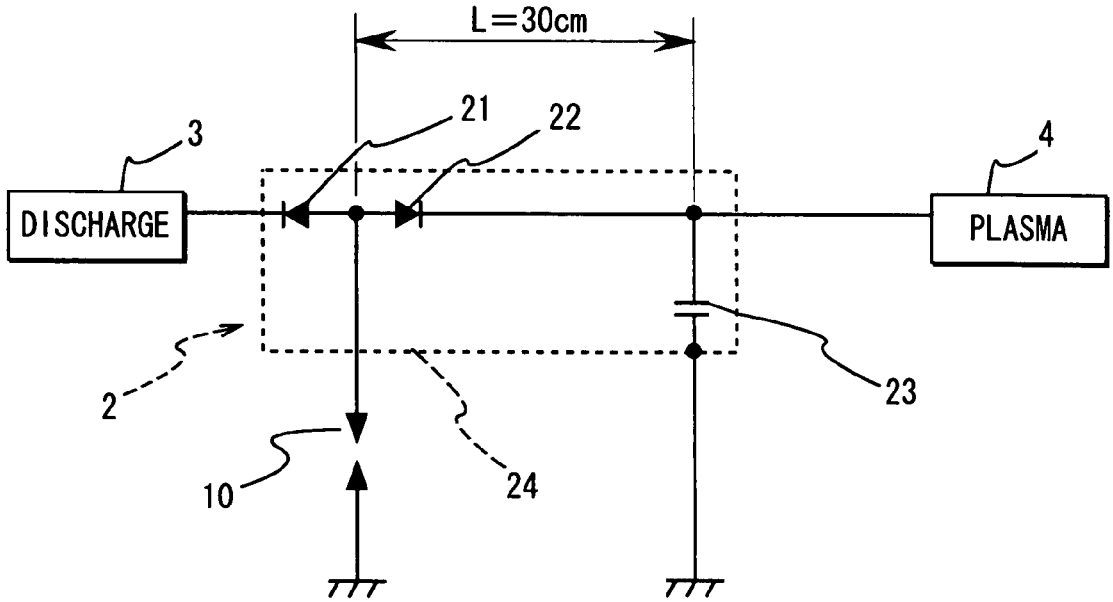

The operation of the embodiment was also compared with additional comparative examples, that is, fourth and fifth comparative examples shown in FIGS. 4A and 4B, respectively. It is noted that the fourth and the fifth comparative examples have the same circuit construction as the first embodiment, but are different in respect of a position of the noise reducing capacitor 23 from the ignition plug 10. Specifically, in the fourth and the fifth comparative examples, the distances L between the capacitor 23 and the ignition plug 10 are set at 40 cm and 30 cm, respectively. The distance L in the embodiment (FIGS. 1, 2) is very short because the noise reducing capacitor 23 (noise reduction circuit 2) is right above the ignition plug 10.

Evaluation results of experimental tests conducted on the embodiment and the comparative examples are indicated in the following table. In this table, the embodiment is identifies by figure numbers and the evaluation result is indicated with respect to a result of engine operation, that is, ignition performance of the engine.

| Sample | FIGS. 1, 2 | FIG. 3A | FIG. 3B | FIG. 3C | FIG. 4A | FIG. 4B |
|---|---|---|---|---|---|---|
| Result | Good | Misfire | Misfire | Misfire | Error | Good |

As understood from this table, the first to the third comparative examples (FIGS. 3A, 3B, 3C) caused misfires (plasma ignition failures) because of a decrease in the discharge potential of the discharging wire 36. This decrease is considered to arise from the position of the capacitor 23. Since the noise reducing capacitor 23 is connected to the ignition plug 10 without any diode, it discharges the discharge current therethrough in addition to reduction in the electromagnetic noise.

According to the embodiment (FIGS. 1, 2), no misfire and no large electromagnetic noise generation were observed. This is considered to arise that the noise reducing capacitor 23 only bypasses high frequency noise, which is generated when the ignition coil 33 applies the secondary voltage to the ignition plug 10, but does not bypass discharge voltage. This is because the noise reducing capacitor 23 is connected to the ignition plug 10 through the second rectifier 22, which blocks the discharge current.

As further understood from the above table, an erroneous operation occurred in ECU 35 (e.g., generation of ignition signal to a different cylinder) in the fourth example (FIG. 4A) although no erroneous operation occurred in the fifth example (FIG. 4B). From this example, it is concluded that the noise reducing capacitor 23 should be disposed within a predetermined distance (length L) of about 30 cm, more preferably within 15 cm.

Second Embodiment

Figure 5:
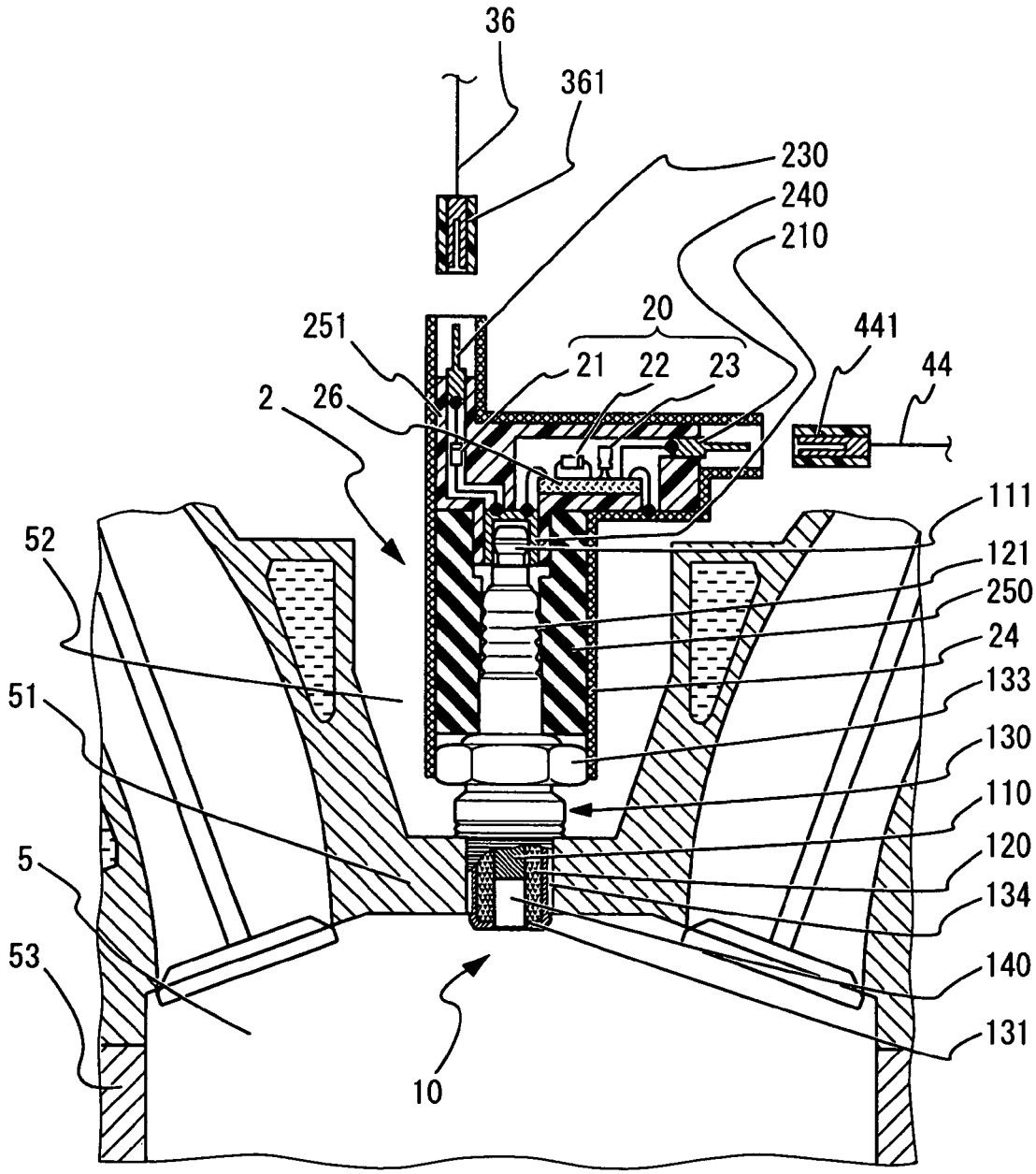
FIG. 5 is a cross sectional view of a plasma ignition system according to a second embodiment of the present invention.

In a second embodiment, as shown in FIG. 5, the plug cap 2 is designed differently. That is, the second terminal 230 for connection to the discharging wire 36 and the third terminal 240 for connection to the plasma generating wire 44 are disposed in a perpendicular relation to each other, so that the plug cap 2 may be reduced in size. No fixing member is provided. Rather, by simply fitting the plug cap 2 onto the ignition plug 10 after tightly threading the ignition plug 10 into the engine block 51, the first terminal 210 connected to the second terminal 230 is fitted onto the terminal 111 of the center electrode 110. The case 24 is fitted onto the hexagonal part 133 and ground, while tightly fitting the insulating member 250 onto the insulator head 121 of the ignition plug 10.

The noise reduction circuit 20 is formed on an insulating substrate having good heat radiating property such as alumina or aluminum nitride, so that the first rectifier 21, the second rectifier 22 and the noise reducing capacitor 23 may radiate heat efficiently.

Further, the capacitor 23 is disposed away from the first rectifier 21 and its wire, and disposed closely to the third terminal 240. The second terminal 230 and the third terminal 240 are located away from each other as long as possible. Thus, a high discharge voltage is restricted from leaking to the capacitor 23, and the noise developed between the noise reducing capacitor 23 and the third terminal 240 is reduced very much.

Third Embodiment

Figure 6:
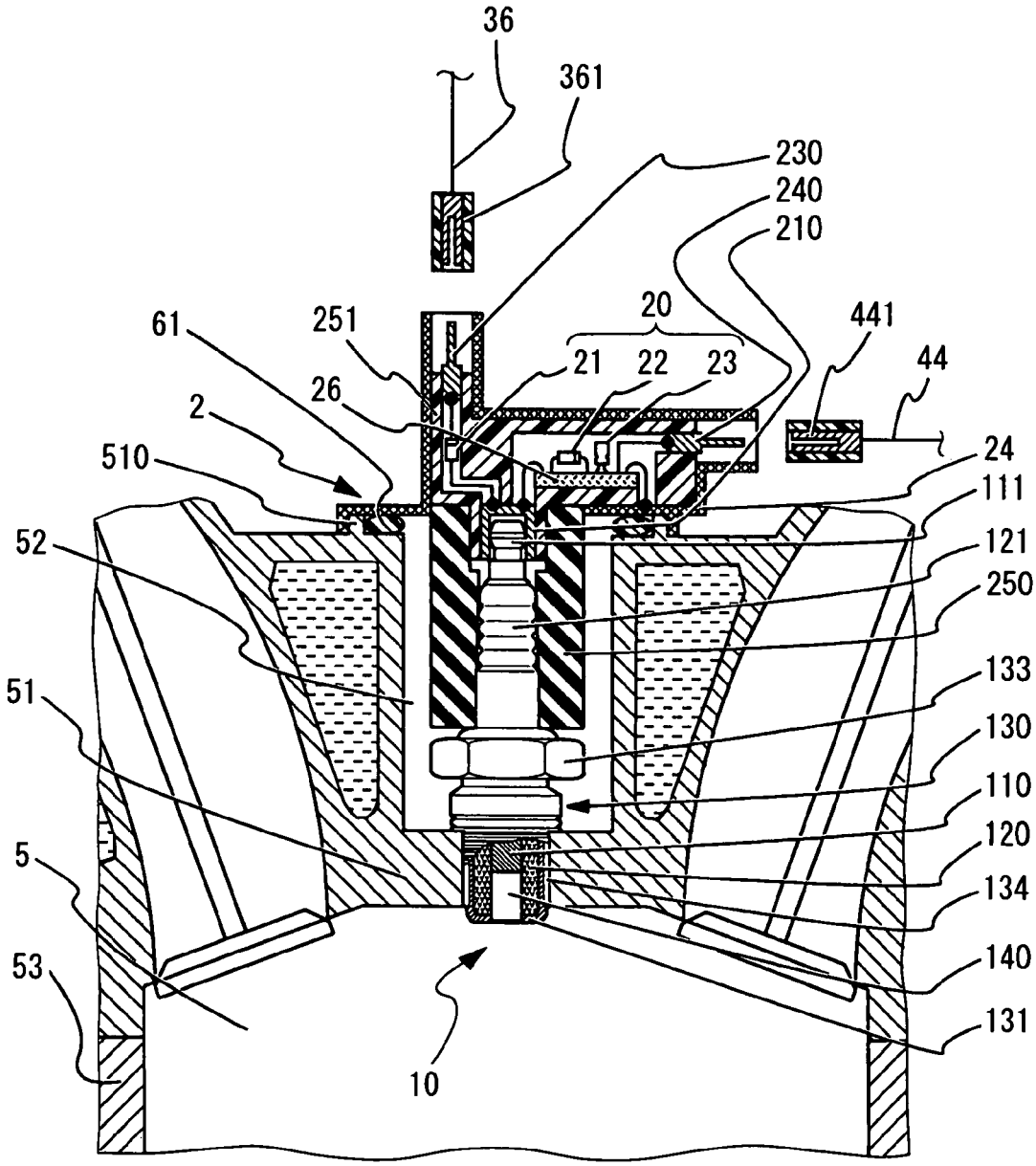
FIG. 6 is a cross sectional view of a plasma ignition system according to a third embodiment of the present invention.

In a third embodiment, as shown in FIG. 6, the plug cap 2 is constructed similarly to that in the second embodiment. It is however different in that the case 24 as the electromagnetic shield is fixed to a fixing part 510, while sandwiching the elastic member 61. The fixing part 510 is a protrusion formed integrally on the engine block 51. Since the engine block 51 functions as an electromagnetic shield, the case 24 has no cylindrical part, which covers the outer periphery of the insulating seal 250 in the plug hole 52. The case 24 therefore covers only a part exposed outside the plug hole 52 thereby restricting electromagnetic noise from leaking.

Fourth Embodiment

Figure 7:
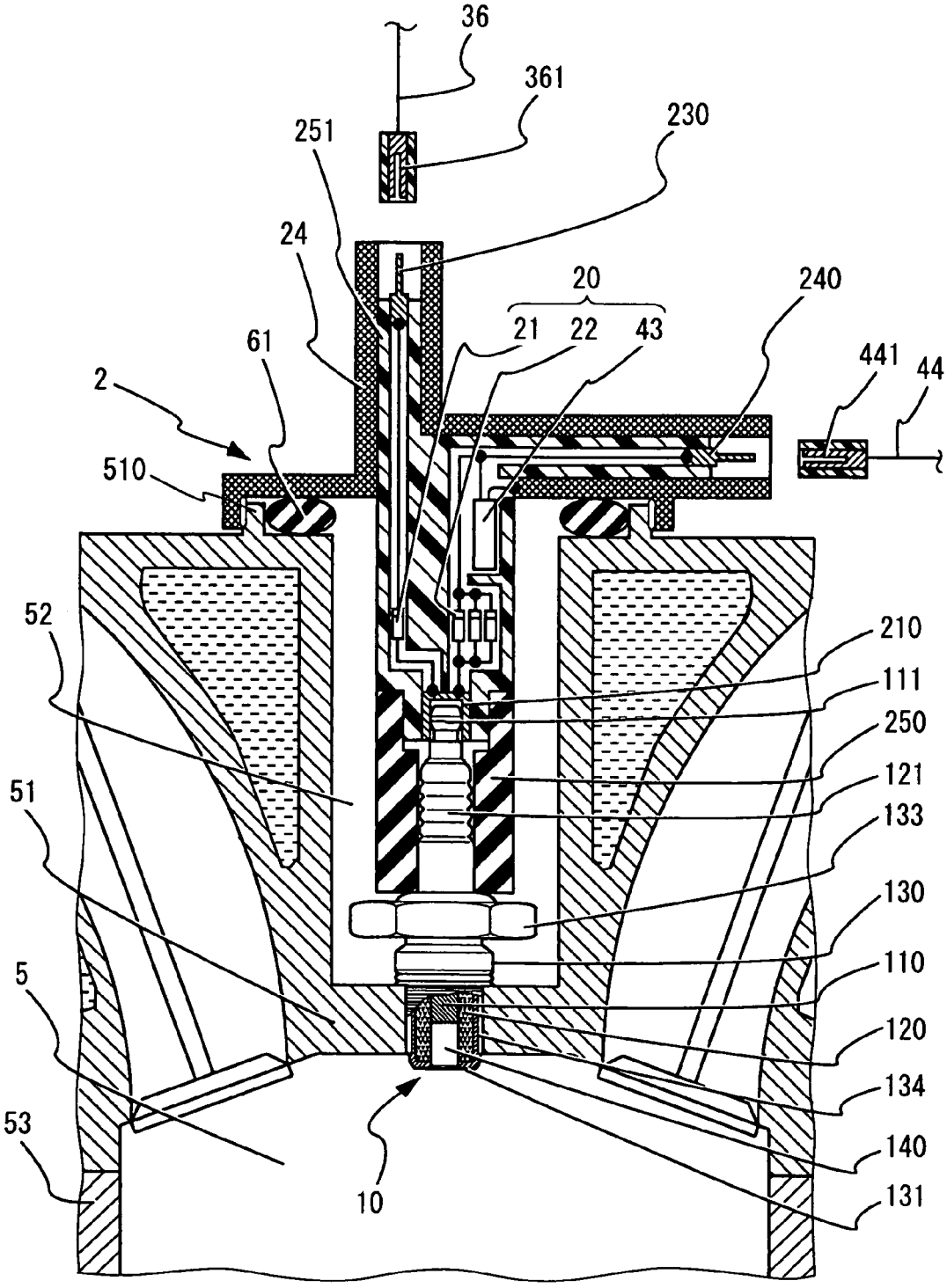
FIG. 7 is a cross sectional view of a plasma ignition system according to a fourth embodiment of the present invention.

In a fourth embodiment, as shown in FIG. 7, the plug cap 2 is constructed similarly to that in the third embodiment. It is however different in that the first rectifier 21 and the second rectifier 22 are located within the plug hole 52, while those were located outside the plug hole 52 in the third embodiment (FIG. 5). Further, at least a part of the plasma generating capacitor or capacitors 43 of the plasma generating power circuit 4 is located near the third terminal 240 as a noise reducing capacitor. The plasma generating capacitor 43 in this embodiment has a large capacitance (e.g., 2 μF), while the noise reducing capacitor 23 in the first to the third embodiments has a small capacitance (e.g., 0.1 to 1.0 μF).

This capacitor 43 thus operates to supply a large current for plasma generation and reduce electromagnetic noise. Thus, only a high frequency noise current generated at the time of discharging is bypassed without attenuating the discharge voltage. As a result, electric circuit configuration is simplified while maximizing the electromagnetic shield effect by the engine block 51.

Fifth Embodiment

Figure 8:
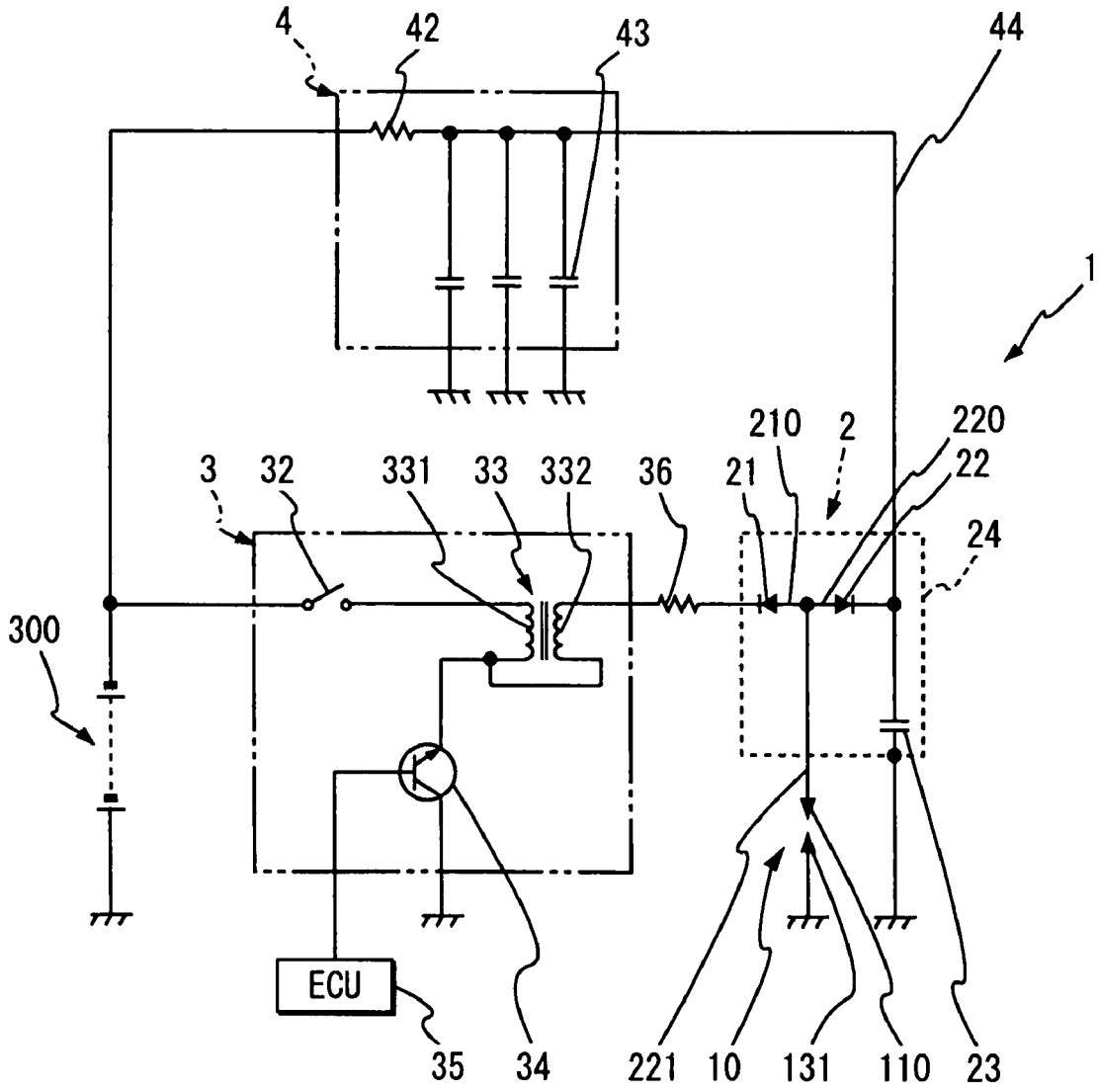
FIG. 8 is a circuit diagram of a plasma ignition system according to a fifth embodiment of the present invention.

In a fifth embodiment, as shown in FIG. 8, only one battery 300 is provided for both the discharging power circuit 3 and the plasma generating power circuit 4, while two batteries 31 and 41 are provided in the first to the fourth embodiments. The positive terminal of the battery 300 is grounded and the negative terminal of the same is connected to the power circuits 3 and 4. The polarity of the igniter (transistor) 34 and the connection of the ignition coil 33 must be reversed correspondingly.

Sixth Embodiment

Figure 9:
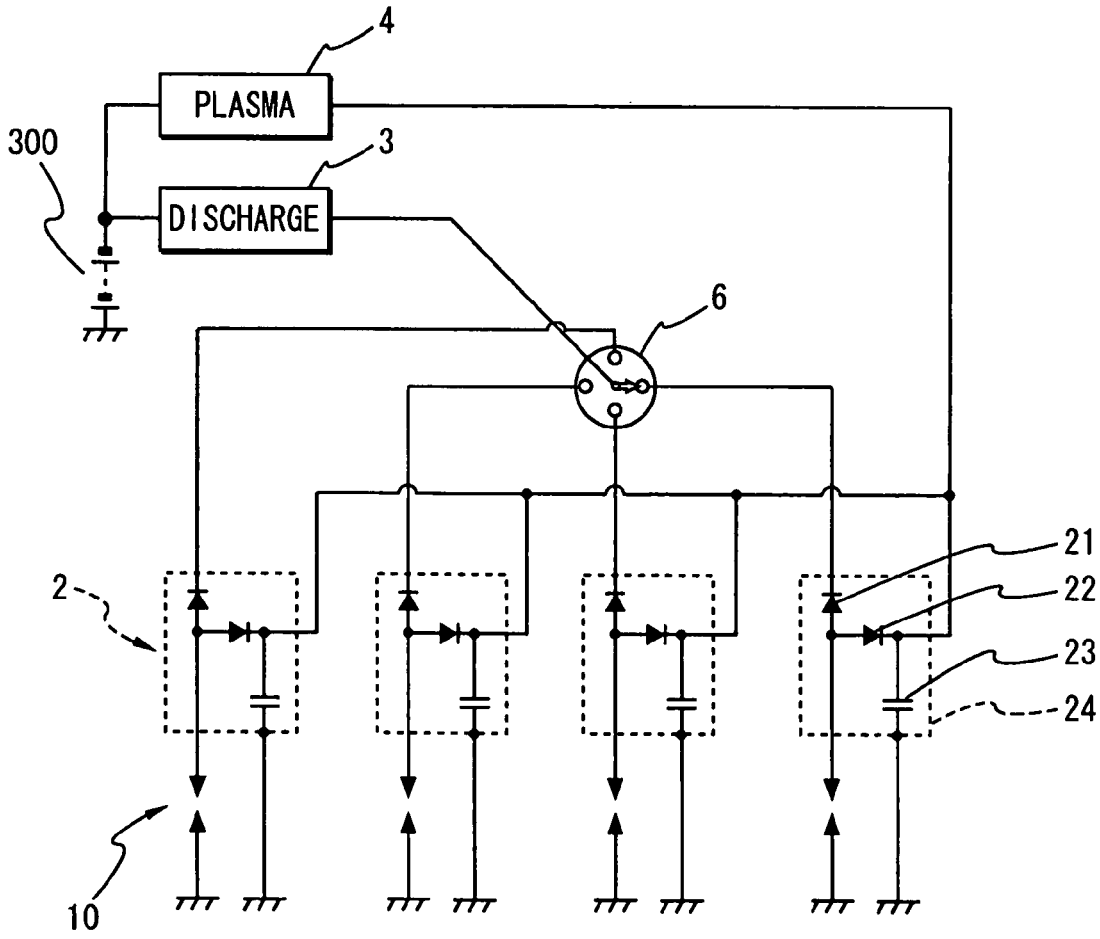
FIG. 9 is a circuit diagram of a plasma ignition system according to a sixth embodiment of the present invention.
Figure 10A:
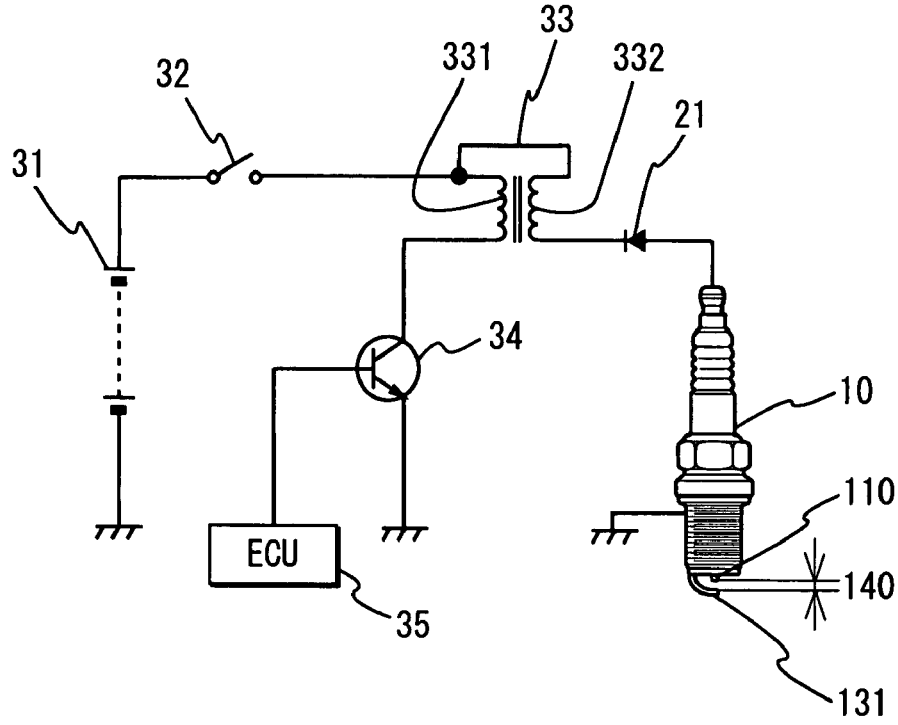
FIG. 10A PRIOR ART
FIGS. 10A and 10B are a circuit diagram and an operation diagram of a conventional normal ignition system.
Figure 10B:
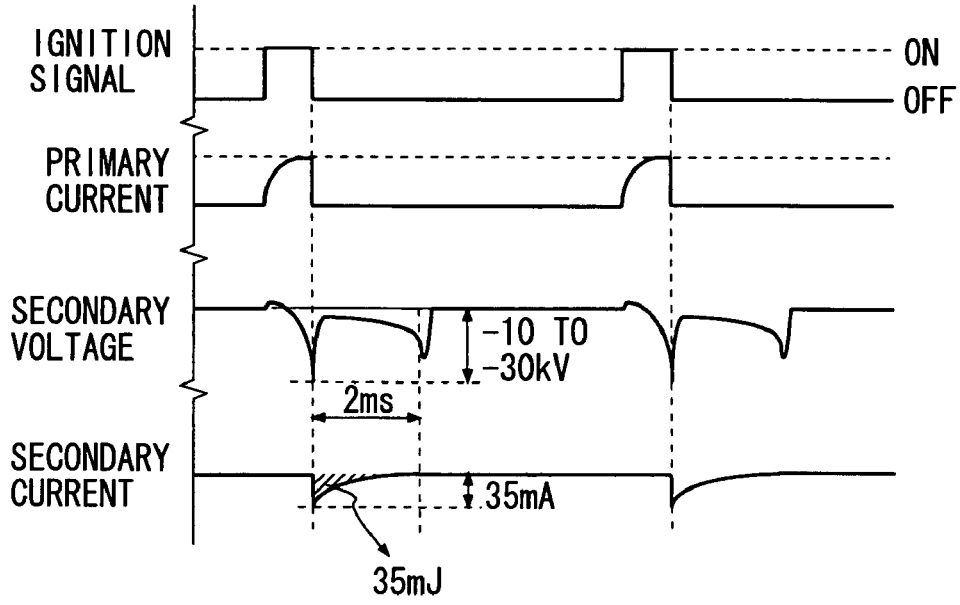
FIG. 10B PRIOR ART
Figure 11A:
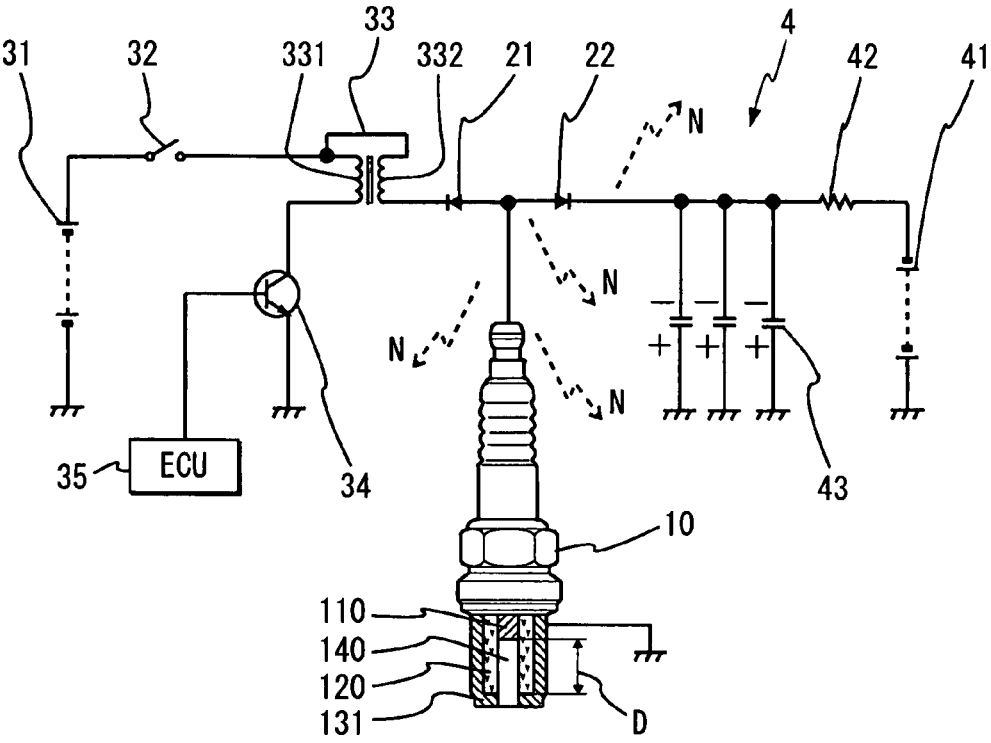
FIG. 11A PRIOR ART
FIGS. 11A and 11B are a circuit diagram and an operation diagram of a conventional plasma ignition system.
Figure 11B:
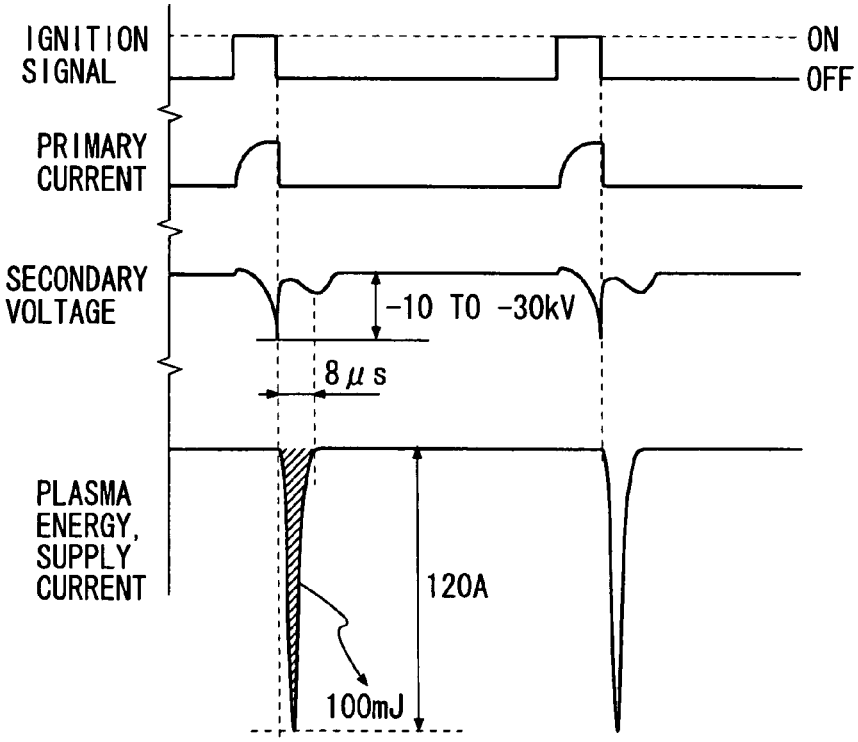
FIG. 11B PRIOR ART

In a sixth embodiment, as shown in FIG. 9, the discharging power circuit 3 including the ignition coil 33 is connected a plurality of ignition plugs 10 through a distributor 6 and a plurality of noise reducing circuits 2. The noise reducing circuits 2 are connected to the plasma generating power circuit 4 through respective plasma generating wires 44. Electromagnetic noise may be effectively reduced by shielding respective plasma generating wires 44 by a single shield member.

The above embodiments may be modified in many ways. For instance, the discharging power circuit 3 and the plasma generating power circuit 4 need not be located away from each but may be integrated to be located at the same place. The output voltages of the discharging power circuit 3 and the plasma generating power circuit 4 may be adjusted by DC-DC converters or the like.

What is claimed is:

1. A plasma ignition system for an engine comprising:

an ignition coil for receiving a primary voltage and generating a secondary voltage higher than the first voltage based on the first voltage;

a discharging power circuit including an igniter for controlling the ignition coil;

a plasma generating power circuit including a plasma generating capacitor, which is charged by a voltage supplied thereto;

an ignition plug mounted on the engine and having a cylindrical discharge space defined by a center electrode and a ground electrode, the ignition plug forming plasma gas in the discharge space by receiving the secondary voltage from the discharging power circuit and a plasma generating power form the plasma generating power circuit;

a discharging wire connecting the discharging power circuit and the center electrode;

a plasma generating wire connecting the plasma generating power circuit and the center electrode; and an electromagnetic noise reduction circuit including a first rectifier, a second rectifier and a noise reducing capacitor, wherein the first rectifier is disposed in the discharging wire to block a current flowing in the plasma generating wire from flowing into the discharging wire, the second rectifier is disposed in the plasma generating wire to block a current flowing in the discharging power wire from flowing into plasma generating power circuit, and the noise reducing capacitor is disposed in parallel to the second rectifier at a position between the plasma generating power circuit and the second rectifier.

2. The plasma ignition system according to claim 1, wherein at least a part of the plasma generating capacitor is disposed within the noise reduction circuit as the noise reducing capacitor.

3. The plasma ignition system according to claim 1, further comprising:

a case disposed around the ignition plug, wherein the noise reduction circuit is disposed within the case.

4. The plasma ignition system according to claim 3, wherein the first rectifier and the second rectifier are disposed within a plug hole formed in an engine block.

5. The plasma ignition system according to claim 3, further comprising:

an insulating mold made of resin filled in the case to encapsulate and hold the noise reduction circuit therein; and an electromagnetic shield connected to the noise reducing capacitor to ground the noise reducing capacitor, and covering at least a part of a surface of the case.

6. The plasma ignition system according to claim 5, wherein the electromagnetic shield covers at least a part exposed outward from the plug hole.

7. The plasma ignition system according to claim 3, further comprising:

a plug cap covering a head of the ignition plug therein and formed integrally with the case.

8. The plasma ignition system according to claim 1, wherein the noise reduction circuit is disposed within 30 cm from the center electrode.

9. The plasma ignition system according to claim 1, wherein the discharging wire is a high voltage wire.

10. The plasma ignition system according to claim 1, wherein the noise reduction circuit includes:

a first terminal connected to the center electrode;

a second terminal connected to the discharging wire; and a third terminal connected to the plasma generating wire, wherein the second terminal and the third terminal are disposed generally in perpendicular relation to each other.

* * * * *